US007313889B2

(12) United States Patent
Karow

(10) Patent No.: US 7,313,889 B2
(45) **Date of Patent: *Jan. 1, 2008**

(54) TEMPORARY GROUND-LEVEL ROAD-EDGE MEMBER AND METHOD FOR POSITIONING BELOW-GROUND STRUCTURES

(76) Inventor: Mark Karow, 35323 - 54th St., Burlington, WI (US) 53105

( * ) Notice: Subject to any disclaimer, the term of this patent is extended or adjusted under 35 U.S.C. 154(b) by 60 days.

This patent is subject to a terminal disclaimer.

(21) Appl. No.: 10/883,407

(22) Filed: Jul. 1, 2004

(65) Prior Publication Data

US 2006/0000157 A1 Jan. 5, 2006

(51) Int. Cl.
*E01C 11/22* (2006.01)
*E02D 29/14* (2006.01)

(52) U.S. Cl. ..... 52/103; 52/20; 404/4; 404/26; 454/48

(58) Field of Classification Search ..... 52/19; 404/25, 4; 454/48; 210/164; 249/8
See application file for complete search history.

(56) References Cited

U.S. PATENT DOCUMENTS

| | | | | |
|---|---|---|---|---|
| 125,118 | A | | 4/1872 | Chase et al. |
| 718,277 | A | | 1/1903 | Peters |
| 729,852 | A | | 6/1903 | Estell |
| 1,092,921 | A | | 4/1914 | Kurtz |
| 1,473,551 | A | | 11/1923 | Gschwing |
| 1,643,960 | A | | 10/1927 | Sice |
| 1,744,278 | A | | 1/1930 | Merriman |
| 2,159,752 | A | | 5/1939 | Shaw |
| 2,354,994 | A | | 8/1944 | Holland |
| 3,217,618 | A | | 11/1965 | Driver et al. |
| 3,426,652 | A | | 2/1969 | Clarke et al. |
| 3,698,290 | A | * | 10/1972 | Wallace ..... 404/7 |
| 3,945,746 | A | | 3/1976 | Bredbenner |
| 4,048,766 | A | * | 9/1977 | Dantzer et al. ..... 52/19 |
| 4,187,647 | A | | 2/1980 | Hall |
| 4,610,566 | A | * | 9/1986 | Albang et al. ..... 404/4 |
| 4,637,585 | A | | 1/1987 | Picollo |
| 4,806,045 | A | | 2/1989 | Pitts et al. |
| 4,808,025 | A | | 2/1989 | McGinnis |
| 4,844,403 | A | | 7/1989 | Castle |
| 4,957,268 | A | | 9/1990 | Picollo et al. |

(Continued)

OTHER PUBLICATIONS

Plastic Solutions Inc.—www.plastic-solution.com web page: Structural Foam Plastic Racks (5 sheets) First known date: Jul. 2001.

*Primary Examiner*—Richard E. Chilcot, Jr.
*Assistant Examiner*—Jared W. Newton
(74) *Attorney, Agent, or Firm*—Jansson Shupe & Munger Ltd.

(57) ABSTRACT

A template for temporary placement on the open upper end of a below-ground structure, including a rectangular body matching key dimensions of a permanent ground-level member to be installed, the body having an open bottom to engage the open upper end of the below-ground structure, a raised top surface, a back road-edge portion on one side of the body, and upright sidewalls. A method for using the template to facilitate adjustment of positioning of below-ground structures on which permanent ground-level members will be installed, the method involving placing, removing and re-placing the template while determining and adjusting positioning of the below-ground structure.

18 Claims, 2 Drawing Sheets

U.S. PATENT DOCUMENTS

| | | | | | |
|---|---|---|---|---|---|
| 4,986,693 | A | | 1/1991 | Salberg et al. | |
| 5,403,474 | A | | 4/1995 | Emery | |
| 5,478,169 | A | * | 12/1995 | Stegall | 405/119 |
| 5,595,457 | A | | 1/1997 | Stucks | |
| 5,720,467 | A | | 2/1998 | Del Zotto | |
| 5,733,444 | A | * | 3/1998 | Johnson | 210/163 |
| 5,843,306 | A | | 12/1998 | Singleton | |
| 6,004,457 | A | | 12/1999 | Singleton | |
| 6,015,489 | A | | 1/2000 | Allen et al. | |
| 6,109,824 | A | | 8/2000 | Annes | |
| 6,234,711 | B1 | * | 5/2001 | Beaman | 404/4 |
| 6,261,445 | B1 | | 7/2001 | Singleton | |
| 6,416,674 | B1 | | 7/2002 | Singleton et al. | |
| 6,428,693 | B2 | | 8/2002 | Singleton | |
| 6,485,226 | B1 | | 11/2002 | Harger | |
| 6,609,852 | B2 | | 8/2003 | Wimberger | |
| 6,692,183 | B2 | | 2/2004 | Godfrey | |
| 6,698,973 | B2 | | 3/2004 | Suatac | |
| 7,074,326 | B2 | * | 7/2006 | Singleton | 210/163 |

* cited by examiner

TEMPORARY GROUND-LEVEL ROAD-EDGE MEMBER AND METHOD FOR POSITIONING BELOW-GROUND STRUCTURES

FIELD OF THE INVENTION

The present invention relates to devices for temporarily covering open ends of below-ground structures such as sewer structures during periods of construction.

BACKGROUND OF THE INVENTION

During the construction of streets, roads and the like, in connection with building developments or otherwise, various below-ground structures are built or installed to accommodate a variety of utility-related needs. Most commonly, these include storm water drainage systems (storm sewers), sanitary sewers, and vault structures of various kinds for electric power systems, communication-related systems or other similar systems. In each case, such below-ground structures or systems have upwardly-projecting portions (still below ground) to which heavy (typically cast-iron) ground-level members are permanently joined in order to provide access openings, for water inflow, maintenance or other access purposes.

Typically, in the construction and installation of such systems along roadways, the principal underground channel members and upwardly-projecting portions are first installed. Then, after the street bed and curbs are completed (or nearly completed), the upper ends of the upwardly-projecting portions are completed (such as by brickwork) and the permanent ground-level members are secured thereto to complete the installation.

The ground-level member must be installed in proper vertical and horizontal (east-west-north-south) position in order to properly match the road level and roadside (curb) configuration. This necessitates proper positioning of the upwardly-extending portion of the below-ground structure. Accurate completion of the upper end of the upwardly-projecting portion of the below-ground structure, by brickwork or otherwise, to allow such proper positioning of the permanent ground-level member can be a difficult operation. Judging accurate positioning of the upper end of the upwardly-projecting portion of the below-ground structure can involve, among other things, manual placement and re-placement (sometimes multiple times) of the heavy cast-iron ground-level member until the below-ground structure is made right to allow proper positioning of the ground-level member.

Permanent ground-level members are extremely heavy, often about 250-500 pounds. Therefore, repetitively placing, removing and re-placing such device in the process of determining how best to complete the upper end of the upwardly-projecting portion of the below-ground structure involves considerable physical strain and accompanying risks. Therefore, there is a need for a device and method overcoming this significant problem.

Attention has been given in the prior art to development of devices for temporary covering of openings to such below-ground structures during the period of construction. Prior temporary covering devices have dealt with safety concerns about open holes and the like; attention has not been directed toward successfully dealing with installation-related problems.

Accordingly, a need exists for an improved temporary ground-level member for covering openings in below-ground utility structures during construction, as well as a need for improved construction methods related to installation of below-ground utility structures and their associated permanent ground-level members.

OBJECTS OF THE INVENTION

It is an object of the invention to provide an improved temporary ground-level member, or template, which addresses and overcomes the problems described above.

Another object of the invention is to provide a template which facilitates the adjustment process of below-ground utility structures, thereby aiding the installation of permanent ground-level members.

Another object of the invention is to provide an improved template for covering the open end of a below-ground utility structure until a permanent ground-level member can be installed.

Still another object of the invention is to provide a template which, while enclosing the open end of a below-ground utility structure, still allows for the free and substantially complete drainage of storm runoff water at the construction site.

Yet another object of the invention is to provide a template with the above advantages which also prevents excessive dirt and debris from being washed into the below-ground drainage system or other utility structure.

How these and other objects are accomplished will become apparent from the following descriptions and the drawings.

SUMMARY OF THE INVENTION

The present invention provides an improved template (or temporary ground-surface member) designed for temporary use at construction sites in relation with below-ground utility structures, such as sewer structures along the roadway. The template is for temporary placement on the open upper end (whether brickwork or otherwise) of a below-ground utility structure. The invention is also a method for facilitating adjustment of the positioning of the portions of such below-ground utility structure to which a heavier permanent ground-surface member will be attached upon completion of the system.

The inventive template includes a rectangular body that is configured to match key dimensions of the heavier permanent ground-level member to be installed on the below-ground structure, such body having an open bottom with an edge configured to engage the open upper end of the below-ground structure, a raised top surface, a back road-edge portion on one side of the body, and three upright sidewalls.

The template body is preferably made of polymeric material, and the body is preferably thermoformed. In some preferred embodiments, the polymeric material is a foamed material, such as STYROFOAM® type material. In some cases, such disposable templates can be made as low-cost disposable items.

In certain preferred embodiments, the top surface includes hand-holes through it to facilitate lifting, placement, removing and re-placement of the template during the construction process. The top surface also preferably has safety-related words formed on it. This can be done readily in the preferred thermoforming process.

Characteristics of certain preferred embodiments include: an outward flange forming at least a portion (and preferably all) of the bottom edge of the template body; the top surface being generally flat and substantially closed; the upright sidewalls of the body including lateral apertures to facilitate water in-flow at a level below the top surface; and the road-edge portion of the body being an upwardly-extending portion that is configured and dimensioned to imitate a curb box of the permanent ground-level member—i.e., to align with and match the curb along the roadway.

The lateral apertures in the upright sidewalls help prevent accumulation of water at the worksite, because the water level does not have to rise to reach any top apertures in the template in order to drain into the below-ground structure. A series of lateral apertures or a single elongate aperture may be used.

In some preferred embodiments, at least one filter is secured to the body to prevent debris from being carried into the below-ground structure. In one preferred embodiment, a single replaceable flat filter sheet is placed under the template and secured by fasteners through the filter and through holes in the bottom flange. In some cases, an accommodation can be made to attach filters over the lateral apertures as an alternative to a filter under the template.

Another aspect of this invention is a method for facilitating adjustment of the positioning along a roadway of the open upper ends of below-ground utility structures to which heavy (typically cast-iron) permanent ground-level members will ultimately be secured. The inventive method includes: installing a below-ground structure into the ground along the roadway; providing a template for placement on such open upper ends, the template is of the type disclosed above; manually placing the template on the open upper end of the below-ground structure; inspecting the placed template to determine whether the below-ground structure is in the proper position; manually lifting and removing the template from the below-ground structure; adjusting the positioning of the open upper end of the below-ground structure (by the nature and position of the brickwork or other upper structure); and manually re-placing the template on the open upper end of the below-ground structure to confirm the proper positioning of the below-ground structure.

In preferred embodiments of the method of this invention, the inspecting step includes determining whether the upwardly-extending portion of the template is in full alignment with the intended location of a roadside curb.

The term "template" as used herein means a structure for temporary placement on the upper open end of a below-ground sewer inlet structure, such template being usable to cover the inlet of such below-ground structure and/or to facilitate adjustment of the positioning of such below-ground structure.

The term "thermoforming" (or "thermoformed") as used herein refers to the well-known method of forming pre-existing flat polymeric sheets into intended shapes by use of a hot press process, usually aided by a vacuum draw.

The term "key dimensions" as used herein means whatever permanent ground-level member dimensions must be replicated in the template to allow installers, using the template, to easily judge the position the permanent ground-level member will assume when installed on the below-ground structure.

The term "curb box" as used herein refers to that portion of a permanent ground-level member that is aligned with a roadside curb.

DETAILED DESCRIPTION OF PREFERRED EMBODIMENTS

Figure 1:
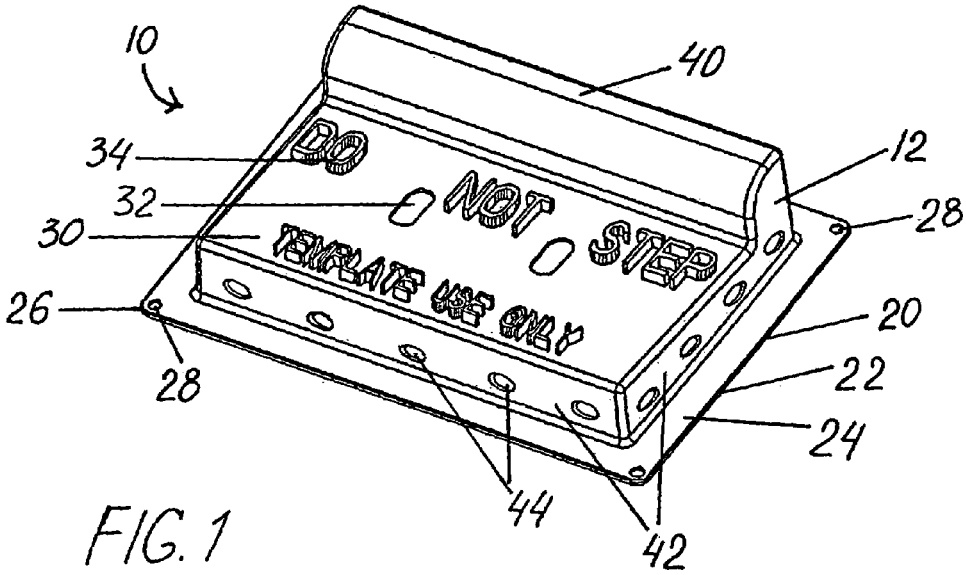
FIG. 1 is a isometric view of a preferred template in accordance with this invention.

FIGS. 1-4 and 6-7 illustrate an improved template 10 which is a preferred embodiment of the invention. Inventive template 10 includes a rectangular body 12. Body 12 has an open bottom 20 with an edge 22 configured to engage the open upper end 52 of the below-ground structure 50, a raised top surface 30, a back road-edge portion 40 on one side of the body 12, and three upright sidewalls 42.

Body 12 is preferably a polymeric material and is preferably thermoformed from a flat polymeric sheet. The material can be a non-foamed tough polyethylene, polypropylene or the like; or it can be a disposable light foamed material, such as STYROFOAM® type material or the like.

Figure 2:
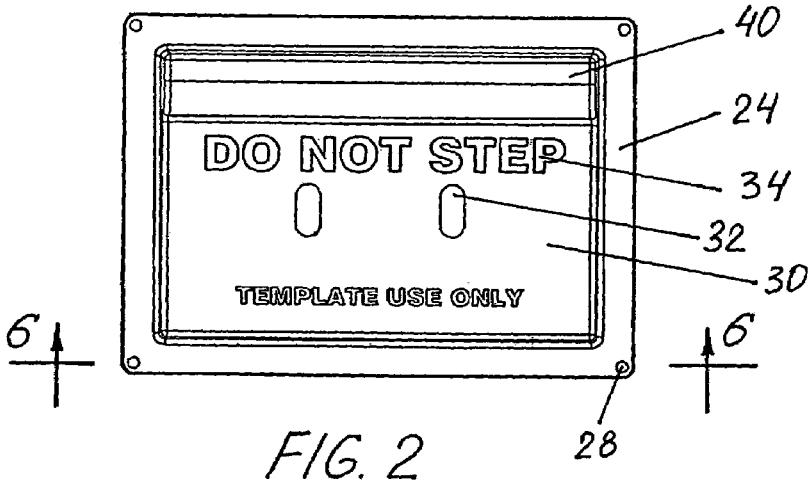
FIG. 2 is a top plan view of the template of FIG. 1.
Figure 3:
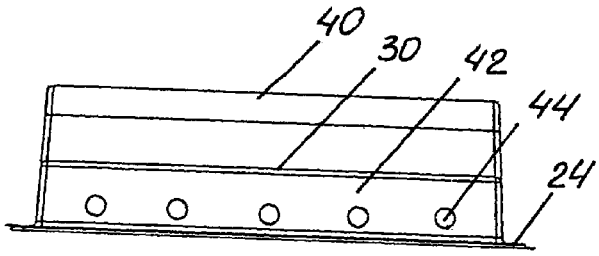
FIG. 3 is a front elevation.
Figure 4:
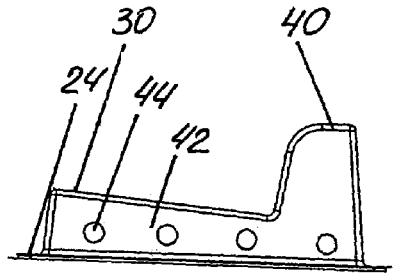
FIG. 4 is a right side elevation.

Top surface 30 includes hand-holes 32 through it to facilitate lifting, placement, removing and re-placement of the template 10 during the construction process. Top surface 30, as seen in FIGS. 1 and 2, has safety-related words 34 formed on it.

Bottom edge 22 of body 12 is formed by an outward flange 24. Outward flange 24 has four corners 26 each of which includes a hole 28 through it.

Figure 5:
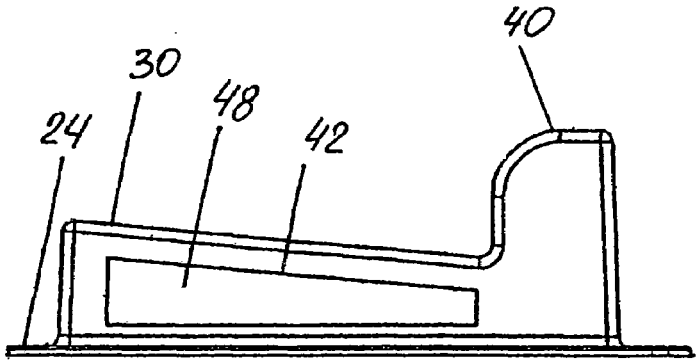
FIG. 5 is a right side elevation of a variation of the template of FIGS. 1-4.

Each upright sidewall 42 of body 12 includes a series of lateral apertures 44 to facilitate water in-flow at a level below top surface 30. Instead of a series of lateral apertures 44, a single elongate aperture 48 can be formed in each upright sidewall 42, as shown in the alternative embodiment of FIG. 5.

Figure 6:
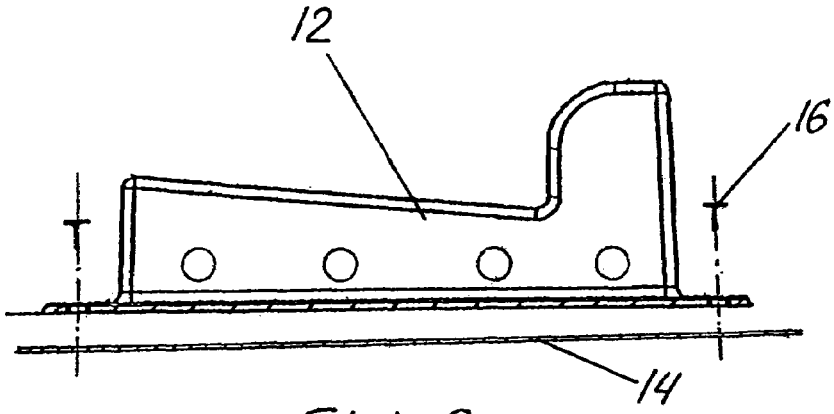
FIG. 6 is an exploded sectional view of the template of FIGS. 1-4 including a filter and fasteners for holding the filter in place, the section being indicated by 6-6 as shown in FIG. 2.

As shown on FIG. 6, a flat filter 14 is secured under body 12 by fasteners 16 through filter 14 and through holes 28 in corners 26 of bottom flange 24.

Figure 7:
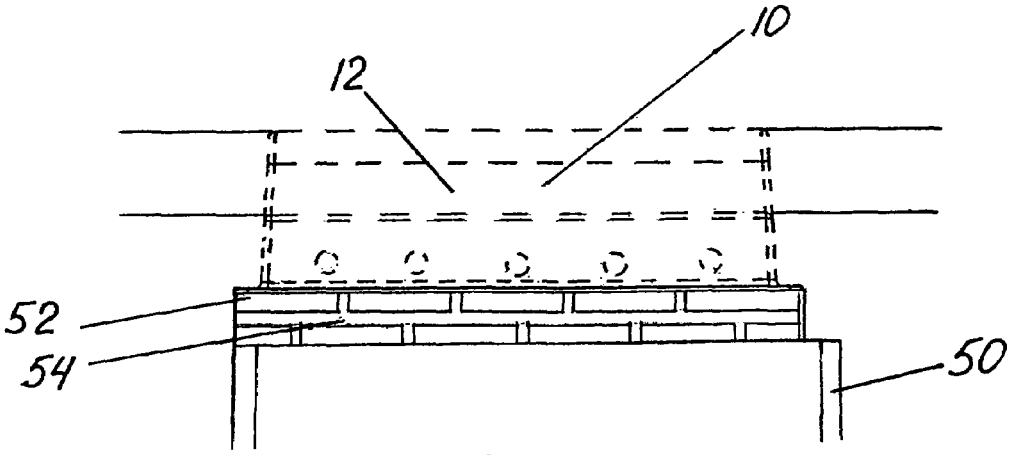
FIG. 7 is a schematic front elevation showing the relationship of the template of this invention to the below-ground structure on which it is placed and to the road surface and curb line.

The method of this invention for facilitating adjustment of the positioning along a roadway of open upper end 52 of below-ground utility structures 50, to which heavy (typically cast-iron) permanent ground-level members will ultimately be secured, is described as follows by particular reference to FIG. 7. After below-ground structure 50 is installed in the ground along the roadway, template 10 is placed manually on open upper end 52, and upon inspection a judgment is made as to whether template 10 is in the position where a permanent ground-level member should be after final installation. If, as is often the case, template 10 is either too high or too low or is out of the proper horizontal position, template 10 can be manually lifted and removed from below-ground structure 50. Thereafter, adjustments are made in the positioning of open upper end 52 of below-ground structure 50 (by the nature and position of the brickwork 54 or other upper structure). Then, template 10 is manually re-placed on open upper end 52 of below-ground structure 50 to confirm the proper positioning thereof. Manual placement, lifting, removal and re-placement are all easy because of the light weight nature of template 10. Depending on its material and construction, template 10 also serves as an excellent protective covering for below-ground structure 50.

In preferred embodiments of the method of this invention, the inspecting step includes determining whether the upwardly-extending portion of the template is in full alignment with the intended location of a roadside curb.

While the principles of the invention have been shown and described in connection with specific embodiments, it is to be understood that such embodiments are by way of example and are not limiting.

The invention claimed is:

1. A template for gauging vertical and horizontal dimensions of an open upper end of a below-ground structure upon which a selected permanent ground-level member having a sidewall extending from a bottom edge to an upper edge is installed, so as to position the upper edge of the ground-level member in proper vertical orientation with respect to an intended level of a completed road and the bottom edge of the ground level member in proper horizontal orientation with respect to the below-ground structure, the template comprising a polymeric impermeable single-piece body substantially lighter in density than the permanent ground-level member, the body having:

a height-gauging sidewall upwardly extending between an upper edge and a bottom edge, the sidewall having a vertical dimension substantially equal to a corresponding vertical dimension of the sidewall of the permanent ground-level member; and a lateral-gauging flange extending substantially orthogonally outward from the bottom edge and configured to securely engage the open upper end of the below-ground structure, the flange having an outside edge defining a horizontal dimension substantially equal to a corresponding horizontal dimension defined by the bottom edge of the permanent ground-level member, whereby temporary placement of the template upon the upper end of the below-ground structure permits horizontal and vertical modification of the upper end of the below-ground structure to be performed so that proper joining of the permanent ground-level member with the below-ground structure can be achieved with a top surface of the permanent ground-level member in full alignment with the intended configuration of the completed road and without repetitive placement, removal and replacement thereof.

2. The template of claim 1 wherein the body is made of a polymeric material.

3. The template of claim 2 wherein the body is thermoformed.

4. The template of claim 2 wherein the polymeric material is a foamed material.

5. The template of claim 1 further includes a top surface at the upper edge, the top surface has hand-holes to facilitate lifting of the template.

6. The template of claim 5 further having safety-related words formed on the top surface.

7. The template of claim 1 wherein:

the upright sidewall includes at least one lateral aperture to facilitate water in-flow at a level below the upper edge.

8. The template of claim 7 wherein the sidewall has a series of lateral apertures.

9. A template for gauging vertical and horizontal dimensions of an open upper end of a below-ground structure upon which a selected permanent ground-level member having a sidewall extending from a bottom edge to an upper edge is installed, so as to position the upper edge of the ground-level member in proper vertical orientation with respect to an intended level of a completed road and the bottom edge of the ground-level member in proper horizontal orientation with respect to the below-ground structure, the template comprising a polymeric impermeable single-piece rectangular body substantially lighter in density than the permanent ground-level member, the body having:

three height-gauging sidewalls upwardly extending between an upper edge defining a top surface and a bottom edge defining an open bottom, each sidewall having a vertical dimension substantially equal to a vertical dimension of the corresponding sidewall of the permanent ground-level member, and a back road-edge portion on one side of the body; and a lateral-gauging flange extending substantially orthogonally outward from the bottom edge and configured to securely engage the open upper end of the below-ground structure, the flange having an outside edge defining a horizontal dimension substantially equal to a corresponding horizontal dimension defined by the bottom edge of the permanent ground-level member, whereby temporary placement of the template upon the upper end of the below-ground structure permits horizontal and vertical modification of the upper end of the below-ground structure to be performed so that proper joining of the permanent ground-level member with the below-ground structure can be achieved with a top surface of the permanent ground-level member in full alignment with the intended configuration of the completed road and without repetitive placement, removal and replacement thereof.

10. The template of claim 9 wherein the body is made of a polymeric material.

11. The template of claim 10 wherein the body is thermoformed.

12. The template of claim 9 wherein the top surface includes hand-holes to facilitate lifting of the template.

13. The template of claim 9 further having safety-related words formed on the top surface.

14. The template of claim 9 wherein each sidewall has a series of lateral apertures.

15. The template of claim 9 wherein:

the top surface is generally flat and substantially closed; and the road-edge portion is an upwardly-extending portion configured and dimensioned to imitate a curb box of the permanent ground-level member.

16. The template of claim 9 wherein the sidewalls have lateral apertures to facilitate water in-flow at a level below the top surface, and the template further includes at least one filter secured to the body to prevent debris from being carried into the below-ground structure.

17. The template of claim 16 wherein:

the outward flange has holes through it; and the at least one filter is a single replaceable flat filter sheet placed under the template and secured by fasteners through the filter and through the holes in the bottom flange.

18. A template for gauging vertical and horizontal dimensions of an open upper end of a below-ground structure upon which a selected permanent ground-level member having a sidewall extending from a bottom edge to an upper edge is installed, so as to position the upper edge of the ground-level member in proper vertical orientation with respect to an intended level of a completed road and the bottom edge of the ground-level member in proper horizontal orientation with respect to the below-ground structure, the template comprising a polymeric impermeable single-piece rectangular body substantially lighter in density than the permanent ground-level member, the body having:

a back road-edge portion on a first side of the body;

a height-gauging front wall on a second side of the body and two height-gauging sidewalls extending between the back road-edge portion and the front wall, each wall upwardly extending between an upper edge and a bottom edge and each having a vertical dimension substantially equal to a corresponding vertical dimension of the wall of the permanent ground-level member;

a top surface supported by the sidewalls at the upper edge, the top surface sloping downward from the front wall to the back road-edge portion; and a lateral-gauging flange extending substantially orthogonally outward from the bottom edge and configured to securely engage the open upper end of the below-ground structure, the flange having an outside edge defining a horizontal dimension substantially equal to a corresponding horizontal dimension defined by the bottom edge of the permanent ground-level member, whereby temporary placement of the template upon the upper end of the below-ground structure permits horizontal and vertical modification of the upper end of the below-ground structure to be performed so that proper joining of the permanent ground-level member with the below-ground structure can be achieved with a top surface of the permanent ground-level member in full alignment with the intended configuration of the completed road and without repetitive placement, removal and replacement thereof.

* * * * *